US006183210B1

(12) United States Patent
Nakamura

(10) Patent No.: US 6,183,210 B1
(45) Date of Patent: Feb. 6, 2001

(54) TORQUE CONTROL DEVICE FOR HYDRAULIC PUMP IN HYDRAULIC CONSTRUCTION EQUIPMENT

(75) Inventor: Kazunori Nakamura, Ibaraki-ken (JP)

(73) Assignee: Hitachi Construction Machinery Co. Ltd., Tokyo (JP)

( * ) Notice: Under 35 U.S.C. 154(b), the term of this patent shall be extended for 0 days.

(21) Appl. No.: 09/269,422

(22) PCT Filed: Sep. 21, 1998

(86) PCT No.: PCT/JP98/04238

§ 371 Date: Mar. 26, 1998

§ 102(e) Date: Mar. 26, 1999

(87) PCT Pub. No.: WO99/17020

PCT Pub. Date: Apr. 8, 1999

(30) Foreign Application Priority Data

Sep. 29, 1997 (JP) ..... 9-264315

(51) Int. Cl.[7] ..... F04B 1/26
(52) U.S. Cl. ..... 417/222.1; 60/431
(58) Field of Search ..... 417/212, 222.1; 60/431, 445

(56) References Cited

U.S. PATENT DOCUMENTS

| | | | | |
|---|---|---|---|---|
| 4,606,313 | | 8/1986 | Izumi et al. | 123/386 |
| 5,285,642 | * | 2/1994 | Watanabe et al. | 60/452 |
| 5,303,551 | * | 4/1994 | Lee | 60/431 |
| 5,481,875 | * | 1/1996 | Takamura | 60/443 |
| 5,638,677 | * | 6/1997 | Hosono et al. | 60/431 |
| 5,944,492 | * | 8/1999 | Konishi et al. | 417/222.1 |
| 5,999,872 | * | 12/1999 | Kinugawa et al. | 701/50 |

FOREIGN PATENT DOCUMENTS

| | | |
|---|---|---|
| 062 072 | 5/1987 | (EP) . |
| 55-102002 | 8/1980 | (JP) . |
| 57-65822 | 4/1982 | (JP) . |
| 60-195338 | 10/1985 | (JP) . |
| 62-8616 | 2/1987 | (JP) . |
| 4-5487 | 1/1992 | (JP) . |

* cited by examiner

*Primary Examiner*—Charles G. Freay
(74) *Attorney, Agent, or Firm*—Mattingly, Stanger & Malur

(57) ABSTRACT

A torque control system for a hydraulic pump in a hydraulic construction machine wherein if an engine output lowers due to change of the environment, modification gain calculating portions 70*m*–70*u* and a torque modification value calculating portion 70*v* receive signals detected by sensors 75–82 and estimate a lowering of the engine output power as a torque modification value ΔTFL. A speed sensing torque deviation modifying portion 70*i* subtracts the torque modification value ΔTFL from a speed sensing torque deviation ΔT1. A resulting torque modification ΔTNL is added to a pump base torque TR0 to determine a suction torque TR1 (target maximum suction torque), and a resulting signal is output to a solenoid control valve 32. The solenoid control valve 32 controls respective servo valves 22 for total horsepower control, thereby controlling the maximum suction torque of the hydraulic pumps 1, 2. As a result, even when the output power of a prime mover lowers, a reduction of the revolution speed of the prime mover can be suppressed at a high load.

8 Claims, 11 Drawing Sheets

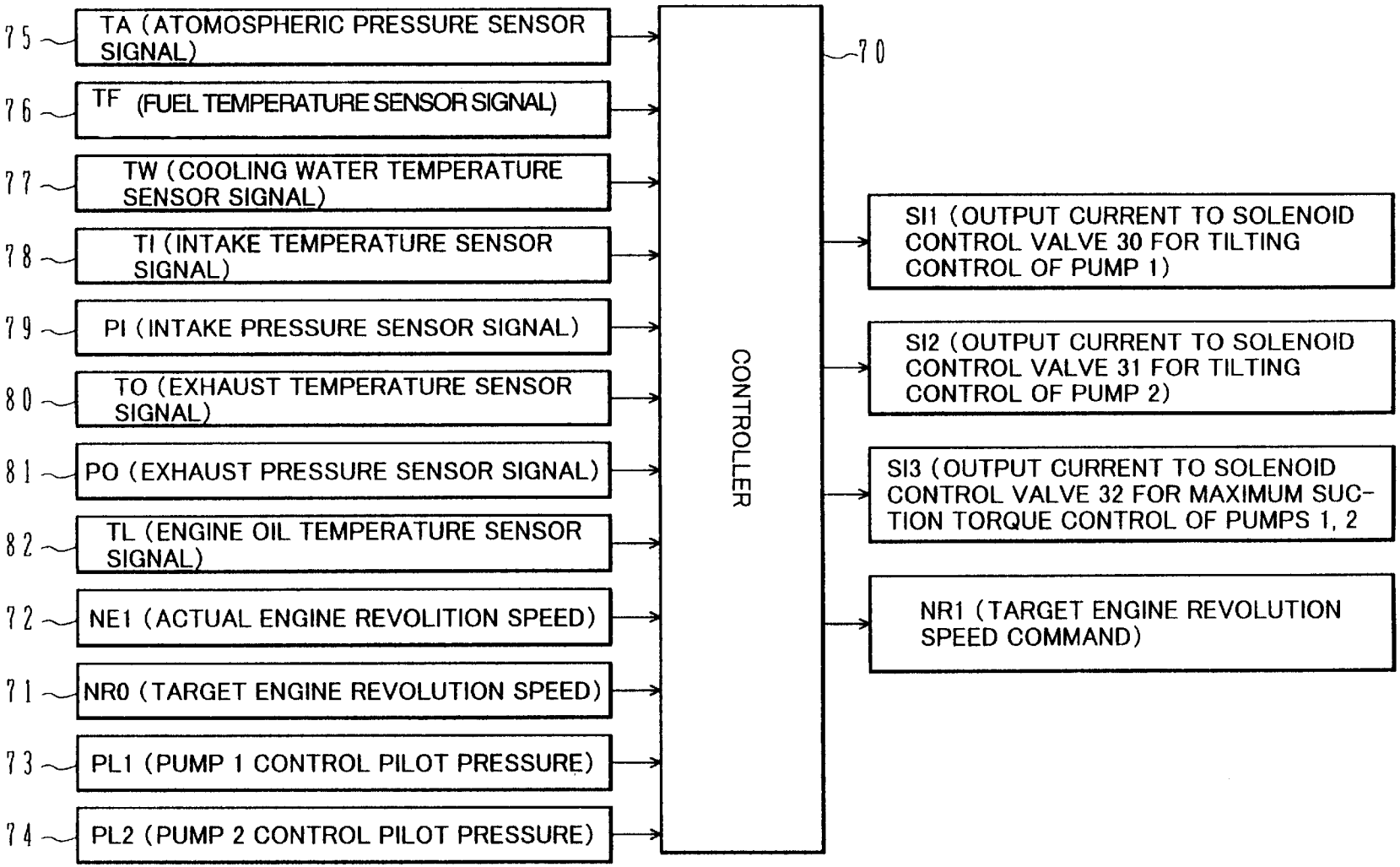
FIG.4
TA (ATOMOSPHERIC PRESSURE SENSOR SIGNAL)
TF (FUEL TEMPERATURE SENSOR SIGNAL)
TW (COOLING WATER TEMPERATURE SENSOR SIGNAL)
TI (INTAKE TEMPERATURE SENSOR SIGNAL)
PI (INTAKE PRESSURE SENSOR SIGNAL)
TO (EXHAUST TEMPERATURE SENSOR SIGNAL)
PO (EXHAUST PRESSURE SENSOR SIGNAL)
TL (ENGINE OIL TEMPERATURE SENSOR SIGNAL)
NE1 (ACTUAL ENGINE REVOLITION SPEED)
NR0 (TARGET ENGINE REVOLUTION SPEED)
PL1 (PUMP 1 CONTROL PILOT PRESSURE)
PL2 (PUMP 2 CONTROL PILOT PRESSURE)
75
76
77
78
79
80
81
82
72
71
73
74
70
CONTROLLER
SI1 (OUTPUT CURRENT TO SOLENOID CONTROL VALVE 30 FOR TILTING CONTROL OF PUMP 1)
SI2 (OUTPUT CURRENT TO SOLENOID CONTROL VALVE 31 FOR TILTING CONTROL OF PUMP 2)
SI3 (OUTPUT CURRENT TO SOLENOID CONTROL VALVE 32 FOR MAXIMUM SUCTION TORQUE CONTROL OF PUMPS 1, 2
NR1 (TARGET ENGINE REVOLUTION SPEED COMMAND)

MATCHING POINTS BETWEEN ENGINE OUTPUT TORQUE AND PUMP SUCTION TORQUE IN INVENTIUON

MATCHING POINTS BETWEEN ENGINE OUTPUT TORQUE AND PUMP SUCTION TORQUE IN PRIOR ART

MATCHING POINTS BETWEEN ENGINE OUTPUT TORQUE AND PUMP SUCTION TORQUE IN INVENTION

TORQUE CONTROL DEVICE FOR HYDRAULIC PUMP IN HYDRAULIC CONSTRUCTION EQUIPMENT

TECHNICAL FIELD

The present invention relates to a torque control system for a hydraulic pump in hydraulic construction machines, and more particularly to a torque control system for a hydraulic pump in hydraulic construction machines such as hydraulic excavators in which a diesel engine is installed as a prime mover and hydraulic actuators are driven by a hydraulic fluid delivered from a hydraulic pump, which is rotatively driven by the engine, to carry out necessary work.

BACKGROUND ART

A hydraulic construction machine such as a hydraulic excavator, generally, includes a diesel engine as a prime mover and carries out necessary work by rotatively driving at least one variable displacement hydraulic pump by the engine and driving hydraulic actuators by a hydraulic fluid delivered from the hydraulic pump. The diesel engine is provided with input means such as an accelerator lever for instructing a target revolution speed, and an amount of injected fuel is controlled depending on the target revolution speed, whereby the revolution speed is controlled.

With respect to control of an engine and a hydraulic pump in such a hydraulic construction machine, JP, A, 62-8618, entitled "Control Method for Driving System Including Internal Combustion Engine and Hydraulic Pump", proposes one control method. The proposed control method is an example of the so-called speed sensing control with which a difference between the target revolution speed and the actual engine revolution speed (i.e., a revolution speed deviation) is determined by a revolution speed sensor, and an input torque of the hydraulic pump is controlled using the revolution speed deviation.

The purpose of that control is to reduce the load torque (input torque) of the hydraulic pump and to prevent the engine from stalling, thereby enabling the engine output power to be effectively utilized, when the detected actual engine revolution speed is reduced relative to the target revolution speed.

DISCLOSURE OF THE INVENTION

Meanwhile, a lowering of the engine output power depends on environment around the engine. When engines are used in highland, for example, the engine output torque is reduced due to a lowering of the atmospheric pressure.

When the engine load is light, some point on a regulation curve of a fuel injection device (governor mechanism) becomes a matching point between the engine load and the output torque. Thus, regardless of a lowering of the engine output power depending on change of the environment, the engine revolution speed is given by a value which is a little higher than the target revolution speed and corresponds to some point on the regulation characteristic curve of the governor mechanism.

When the engine load increases, a matching point is established between the engine load and the output torque corresponding to the target revolution speed that is determined by an engine output torque characteristic specific to the engine. In the case of such a matching point being effective, if the engine output power lowers due to change of the environment, the above-mentioned speed sensing control is performed such that a suction torque of the hydraulic pump is reduced in accordance with a lowering of the engine revolution speed to establish a match at a point where the suction torque of the hydraulic pump and the engine output torque are equal to each other.

In the above prior art, therefore, if the engine output power lowers due to change of the environment under an increased engine load, the engine revolution speed is reduced to a large extent as the engine load changes from a light load to a high load. For example, where a hydraulic construction machine is a hydraulic excavator and excavation is to be carried out with the hydraulic excavator in high ground, the engine revolution speed is given by a value a little higher than the target revolution speed entered by an operator when a bucket is empty, but the engine revolution speed is greatly reduced when excavation of earth and sand is started.

This changes noise and vibration of a machine body attributable to the engine revolution speed, thus making the operator more fatigued.

It is an object of the present invention to provide a torque control system for a hydraulic pump in hydraulic construction machines which can suppress a reduction of the revolution speed of a prime mover at a high load even when an output power of the prime mover lowers due to change of the environment.

To achieve the above object, the constructions and associated features employed in the present invention are as follows.

(1) To achieve the above object, according to the present invention, in a torque control system for a hydraulic pump in a hydraulic construction machine comprising a prime mover, a variable displacement hydraulic pump driven by the prime mover, input means for instructing a target revolution speed of the prime mover, first detecting means for detecting an actual revolution speed of the prime mover, and speed sensing control means for calculating a deviation between the target revolution speed and the actual revolution speed and controlling a maximum suction torque of the hydraulic pump in accordance with the calculated deviation, the torque control system includes second detecting means for detecting status variables relating to the environment of the prime mover, and torque modifying means for, in accordance with values detected by the second detecting means, modifying the maximum suction torque of the hydraulic pump to be controlled by the speed sensing control means.

Here, the status variables relating to the environment of the prime mover and detected by the second detecting means may include a cooling water temperature, an intake temperature, an engine oil temperature, an exhaust temperature, an atmospheric pressure, intake pressure, exhaust pressure and so on.

By detecting the status variables relating to the environment of the prime mover by the second detecting means and modifying the maximum suction torque of the hydraulic pump in accordance with the detected values by the torque modifying means, the maximum suction torque of the hydraulic pump can be reduced beforehand in an amount by which the output power of the prime mover lowers due to change of the environment. Accordingly, even when the output power of the prime mover lowers due to change of the environment, the revolution speed of the prime mover at a maximum torque matching point is not reduced to a large extent, and satisfactory working efficiency can be ensured with a small reduction in the revolution speed of the prime mover.

(2) In the above (1), preferably, the speed sensing control means comprises means for calculating a target maximum suction torque of the hydraulic pump based on the target revolution speed and the revolution speed deviation, and means for limitingly controlling a maximum displacement of the hydraulic pump in accordance with the target maximum suction torque, and the torque modifying means modifies the target maximum suction torque in accordance with the values detected by the second detecting means.

By so modifying the target maximum suction torque, the maximum suction torque of the hydraulic pump can be modified.

(3) In the above (1), preferably, the torque modifying means comprises means for, for each of the status variables relating to the environment of the prime mover, determining an output power change of the prime mover corresponding to the detected value of the instantaneous status variable from a preset relationship between the status variable and the output power change, and means for modifying the maximum suction torque of the hydraulic pump in accordance with the output power change.

With this feature, the torque modifying means can estimate an amount by which the output power of the prime mover lowers due to change of the environment, and the maximum suction torque of the hydraulic pump can be reduced in accordance with the estimated value.

(4) In the above (3), preferably, the torque modifying means further comprises means for determining a modification value corresponding to the instantaneous output power change of the prime mover from a preset weighting function for the output power change depending on the status variables relating to the environment of the prime mover, and the means for modifying the maximum suction torque of the hydraulic pump in accordance with the output power change modifies the maximum suction torque of the hydraulic pump in accordance with the modification value.

With this feature, based on the detected values of the status variables relating to the environment of the prime mover, the torque modifying means can calculate the modification value corresponding to the amount by which the output power of the prime mover lowers.

(5) In the above (1), preferably, the speed sensing control means comprises first means for calculating a pump base torque in accordance with the target revolution speed, calculating a speed sensing torque deviation in accordance with the revolution speed deviation, and adding the speed sensing torque deviation to the pump base torque to provide the target maximum suction torque of the hydraulic pump, and second means for limitingly controlling a maximum displacement of the hydraulic pump in accordance with the target maximum suction torque, and the torque modifying means comprises third means for calculating a torque modification value for the target maximum suction torque in accordance with the values detected by the second detecting means, and fourth means for subtracting the torque modification value when the speed sensing torque deviation is added to the pump base torque by the first means, thereby modifying the target maximum suction torque.

Thus, the maximum suction torque of the hydraulic pump can be modified by determining, as the torque modification value, the amount by which the output power of the prime mover lowers due to change of the environment, and subtracting the torque modification value from the pump base torque, thereby modifying the target maximum suction torque.

(6) In the above (1), preferably, the speed sensing control means comprises first means for calculating a pump base torque in accordance with the target revolution speed, subtracting the target revolution speed from the actual revolution speed to determine the revolution speed deviation, and modifying the pump base torque in accordance with the revolution speed deviation to provide the target maximum suction torque of the hydraulic pump, and second means for limitingly controlling a maximum displacement of the hydraulic pump in accordance with the target maximum suction torque, and the torque modifying means comprises third means for calculating a revolution speed modification value for the target revolution speed in accordance with the values detected by the second detecting means, and fourth means for further subtracting the revolution speed modification value when the target revolution speed is subtracted from the actual revolution speed by the first means.

Thus, the amount by which the output power of the prime mover lowers due to change of the environment may be provided as the revolution speed modification value. In this case, the maximum suction torque can be modified by further subtracting the revolution speed modification value when the target revolution speed is subtracted from the actual revolution speed.

BRIEF DESCRIPTION OF THE DRAWINGS

FIG. 4 is a diagram showing input/output relations of a controller shown in FIG. 1.

BEST MODE FOR CARRYING OUT THE INVENTION

Embodiments of the present invention will be described below with reference to the drawings. In the following embodiments, the present invention is applied to an engine/pump control system for a hydraulic excavator.

To begin with, a first embodiment of the present invention will be described with reference to FIGS. 1–8.

Figure 1:
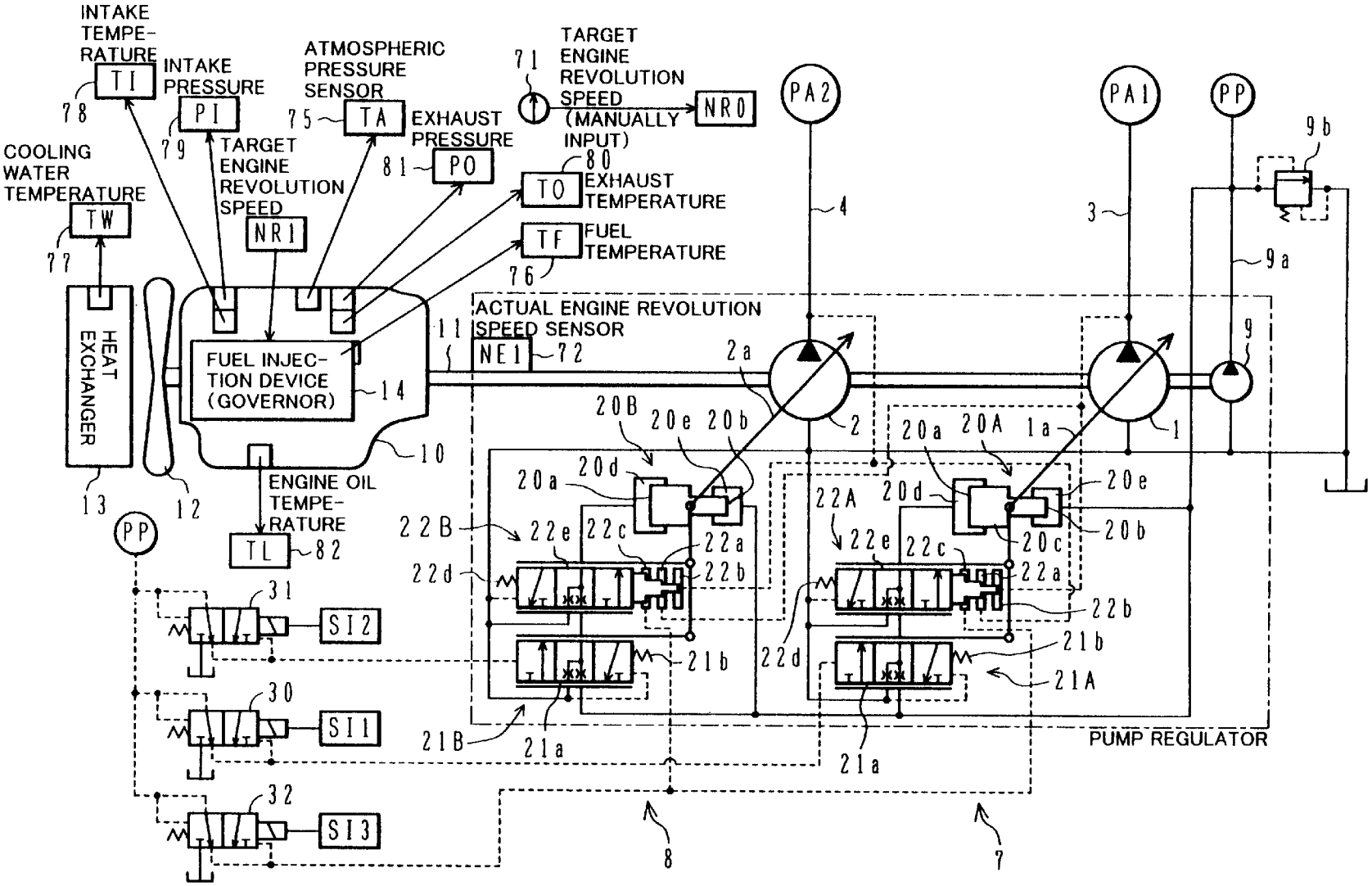
FIG. 1 is a diagram showing an engine/pump control system including a torque control system for a hydraulic pump according to a first embodiment of the present invention.
Figure 2:
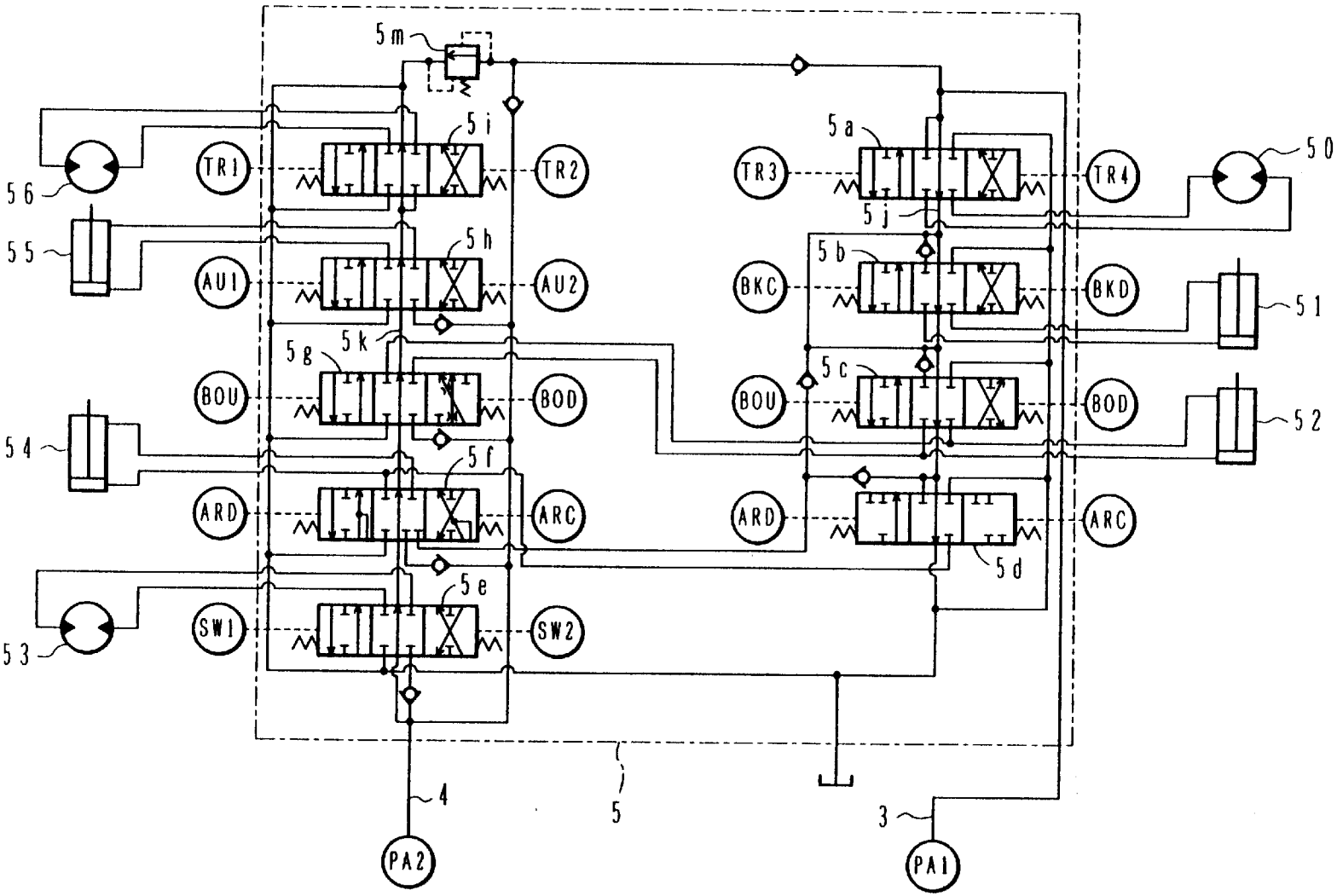
FIG. 2 is a hydraulic circuit diagram of actuators and a valve unit connected to hydraulic pumps shown in FIG. 1.

In FIG. 1, reference numerals 1 and 2 denote variable displacement hydraulic pumps of the swash plate type, for example. A valve unit 5 shown in FIG. 2 is connected to delivery lines 3, 4 of the hydraulic pumps 1, 2. A hydraulic fluid is supplied to a plurality of actuators 50–56 through the valve unit 5 for driving the actuators.

Reference numeral 9 denotes a fixed displacement pilot pump. A pilot relief valve 9*b* for holding the delivery pressure of the pilot pump 9 at a constant level is connected to a delivery line 9*a* of the pilot pump 9.

The hydraulic pumps 1, 2 and the pilot pump 9 are coupled to an output shaft 11 of a prime mover 10 and are rotatably driven by the prime mover 10. Reference numeral 12 denotes a cooling fan, and 13 denotes a heat exchanger.

Details of the valve unit 5 will now be described.

In FIG. 2, the valve unit 5 includes two valve groups; flow control valves 5*a*–5*d* and flow control valves 5*e*–5*i*. The flow control valves 5*a*–5*d* are positioned on a center bypass line 5*j* which is connected to the delivery line 3 of the hydraulic pump 1, and the flow control valves 5*e*–5*i* are positioned on a center bypass line 5*k* which is connected to the delivery line 4 of the hydraulic pump 2. The delivery lines 3, 4 include a main relief valve 5m for fixing a maximum value of the delivery pressure of the hydraulic pumps 1, 2.

The flow control valves 5*a*–5*d* and the flow control valves 5*e*–5*i* are all center bypass valves, and hydraulic fluids delivered from the hydraulic pumps 1, 2 are supplied through the flow control valves to corresponding ones of the actuators 50–56. The actuator 50 is a hydraulic motor for a track on the right side (right track motor), the actuator 51 is a hydraulic cylinder for a bucket (bucket cylinder), the actuator 52 is a hydraulic cylinder for a boom (boom cylinder), the actuator 53 is a hydraulic motor for a swing (swing motor), the actuator 54 is a hydraulic cylinder for an arm (arm cylinder), the actuator 55 is a hydraulic cylinder for reserve, and the actuator 56 is a hydraulic motor for a track on the left side (left track motor). The flow control valve 5*a* is associated with the track on the right side, the flow control valve 5*b* is associated with the bucket, the flow control valve 5*c* is the first one associated with the boom, the flow control valve 5*d* is the second one associated with the arm, the flow control valve 5*e* is associated with the swing, the flow control valve 5*f* is the first one associated with the arm, the flow control valve 5*g* is the second one associated with the boom, the flow control valve 5*h* is for reserve, and the flow control valve 5*i* is associated with the track on the left side. In other words, two flow control valves 5*g*, 5*c* are provided for the boom cylinder 52 and two flow control valves 5*d*, 5*f* are provided for the arm cylinder 54 so that the hydraulic fluids delivered from the hydraulic pumps 1, 2 can be joined together and supplied to each of the boom cylinder 52 and the arm cylinder 54 on the bottom side.

Figure 3:
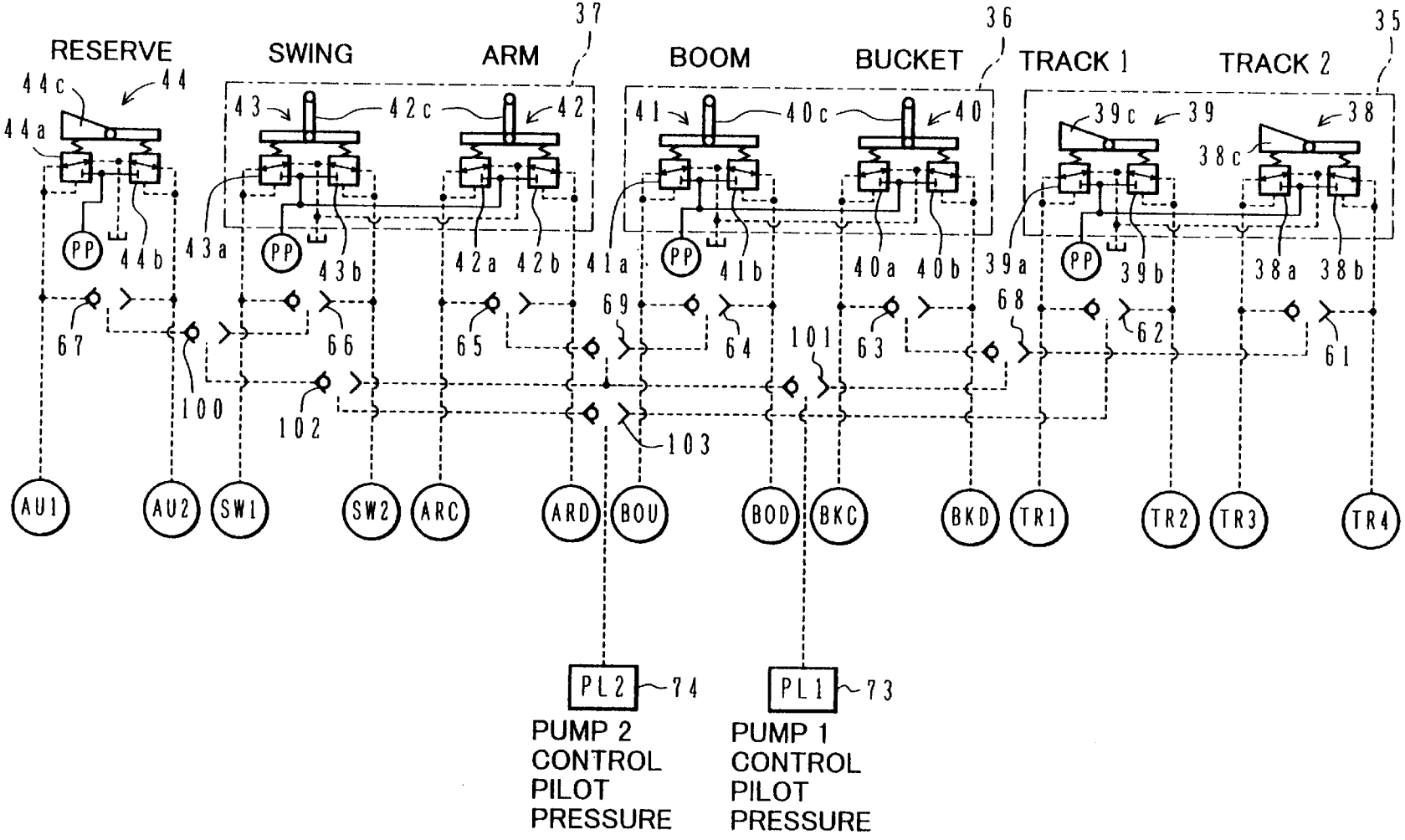
FIG. 3 is a diagram showing an operation pilot system for flow control valves shown in FIG. 2.

FIG. 3 shows an operation pilot system for the flow control valves 5*a*–5*i*.

The flow control valves 5*i*, 5*a* are shifted by operation pilot pressures TR1, TR2; TR3, TR4 from operation pilot devices 39, 38 of an operating unit 35, respectively. The flow control valve 5*b* and the flow control valves 5*c*, 5*g* are shifted by operation pilot pressures BKC, BKD; BOD, BOU from operation pilot devices 40, 41 of an operating unit 36, respectively. The flow control valves 5*d*, 5*f* and the flow control valve 5*e* are shifted by operation pilot pressures ARC, ARD; SW1, SW2 from operation pilot devices 42, 43 of an operating unit 37, respectively. The flow control valve 5*h* is shifted by operation pilot pressures AU1, AU2 from an operating pilot device 44.

The operation pilot devices 38–44 comprise respectively pairs of pilot valves (pressure reducing valves) 38*a*, 38*b*–44*a*, 44*b*. The operation pilot devices 38, 39, 44 further comprise respectively control pedals 38*c*, 39*c*, 44*c*. The operation pilot devices 40, 41 further comprise a common control lever 40*c*, and the operation pilot devices 42, 43 further comprise a common control lever 42*c*. When any of the control pedals 38*c*, 39*c*, 44*c* and the control levers 40*c*, 42*c* is operated, one of the pilot valves of the associated operation pilot device is shifted depending on the direction in which the control pedal or lever is operated, and an operation pilot pressure is generated depending on the input amount by which the control pedal or lever is operated.

Shuttle valves 61–67 are connected to output lines of the respective pilot valves of the operation pilot devices 38–44. Other shuttle valves 68, 69 and 100–103 are further connected to the shuttle valves 61–67 in a hierarchical structure. The shuttle valves 61, 63, 64, 65, 68, 69 and 101 cooperatively detect the maximum of the operation pilot pressures from the operation pilot devices 38, 40, 41 and 42 as a control pilot pressure PL1 for the hydraulic pump 1. The shuttle valves 62, 64, 65, 66, 67, 69, 100, 102 and 103 cooperatively detect the maximum of the operation pilot pressures from the operation pilot devices 39, 41, 42, 43 and 44 as a control pilot pressure PL2 for the hydraulic pump 2.

The engine/pump control system including the torque control system for a hydraulic pump according to the present invention is installed in the hydraulic drive system described above. Details of the control system will be described below.

Returning to FIG. 1, the hydraulic pumps 1, 2 are provided with regulators 7, 8 for controlling tilting positions of swash plates 1*a*, 2*a* of displacement varying mechanisms for the hydraulic pumps 1, 2, respectively.

The regulators 7, 8 of the hydraulic pumps 1, 2 comprise, respectively, tilting actuators 20A, 20B (hereinafter represented simply by 20), first servo valves 21A, 21B (hereinafter represented simply by 21) for positive tilting control based on the operation pilot pressures from the operation pilot devices 38–44 shown in FIG. 3, and second servo valves 22A, 22B (hereinafter represented simply by 22) for total horsepower control of the hydraulic pumps 1, 2. These servo valves 21, 22 control the pressure of a hydraulic fluid delivered from the pilot pump 9 and acting on the tilting actuators 20, thereby controlling the tilting positions of the hydraulic pumps 1, 2.

Details of the tilting actuators 20 and the first and second servo valves 21, 22 will now be described.

The tilting actuators 20 each comprise an operating piston 20*c* provided with a large-diameter pressure bearing portion 20*a* and a small-diameter pressure bearing portion 20*b* at opposite ends thereof, and pressure bearing chambers 20*d*, 20*e* in which the pressure bearing portions 20*a*, 20*b* are positioned respectively. When pressures in both the pressure bearing chambers 20*d*, 20*e* are equal to each other, the operating piston 20*c* is moved to the right on the drawing, whereupon the tilting of the swash plate 1*a* or 2*a* is diminished to reduce the pump delivery rate. When the pressure in the large-diameter pressure bearing chamber 20*d* lowers, the operating piston 20*c* is moved to the left on the drawing, whereupon the tilting of the swash plate 1*a* or 2*a* is enlarged to increase the pump delivery rate. Further, the large-diameter pressure bearing chamber 20*d* is connected to a delivery line 9*a* of the pilot pump 9 through the first and second servo valves 21, 22, whereas the small-diameter pressure bearing chamber 20*e* is directly connected to the delivery line 9*a* of the pilot pump 9.

The first servo valves 21 for positive tilting control are each a valve operated by a control pressure from a solenoid control valve 30 or 31 for controlling the tilting position of the hydraulic pump 1 or 2. When the control pressure is high, a valve body 21*a* is moved to the right on the drawing, causing the pilot pressure from the pilot pump 9 to be transmitted to the pressure bearing chamber 20*d* without being reduced, whereby the tilting of the hydraulic pump 1 or 2 is reduced. As the control pressure lowers, the valve body 21*a* is moved to the left on the drawing by the force of a spring 21*b*, causing the pilot pressure from the pilot pump 9 to be transmitted to the pressure bearing chamber 20*d* after being reduced, whereby the tilting of the hydraulic pump 1 or 2 is increased.

The second servo valves 22 for total horsepower control are valves operated respectively by the delivery pressures of the hydraulic pumps 1, 2 and a control pressure from a solenoid control valve 32, thereby effecting the total horsepower control for the hydraulic pumps 1, 2. A maximum suction torque of the hydraulic pumps 1, 2 is limit-controlled by the solenoid control valve 32.

More specifically, the delivery pressures of the hydraulic pumps 1, 2 and the control pressure from the solenoid control valve 32 are introduced respectively to pressure bearing chambers 22*a*, 22*b*, 22*c* in an operation drive sector. When the sum of hydraulic pressure forces given by the delivery pressures of the hydraulic pumps 1 and 2 is lower than a setting value which is determined by a difference between the resilient force of a spring 22*d* and the hydraulic pressure force given by the control pressure introduced to the pressure bearing chamber 22*c*, a valve body 22*e* is moved to the right on the drawing, causing the pilot pressure from the pilot pump 9 to be transmitted to the pressure bearing chamber 20*d* after being reduced, whereby the tilting of the hydraulic pump 1 or 2 is increased. As the sum of hydraulic pressure forces given by the delivery pressures of the hydraulic pumps 1 and 2 rises over the setting value, the valve body 22*e* is moved to the left on the drawing, causing the pilot pressure from the pilot pump 9 to be transmitted to the pressure bearing chamber 20*d* without being reduced, whereby the tilting of the hydraulic pump 1 or 2 is reduced. Further, when the control pressure from the solenoid control valve 32 is low, the setting value is increased so that the tilting of the hydraulic pump 1 or 2 starts reducing from a relatively high delivery pressure of the hydraulic pump 1 or 2, and as the control pressure from the solenoid control valve 32 rises, the setting value is decreased so that the tilting of the hydraulic pump 1 or 2 starts reducing from a relatively low delivery pressure of the hydraulic pump 1 or 2.

The solenoid control valves 30, 31, 32 are proportional pressure reducing valves operated by drive currents SI1, SI2, SI3, respectively, such that the control pressures output from them are maximized when the drive currents SI1, SI2, SI3 are minimum, and are lowered as the drive currents SI1, SI2, SI3 increase. The drive currents SI1, SI2, SI3 are output from a controller 70 shown in FIG. 4.

The prime mover 10 is a diesel engine and includes a fuel injection device 14. The fuel injection device 14 has a governor mechanism and controls the engine revolution speed to become coincident with a target engine revolution speed command NR1 based on an output signal from the controller 70 shown in FIG. 4.

There are several types of governor mechanisms for use in the fuel injection device, e.g., an electronic governor control unit for effecting control to achieve the target engine revolution speed directly based on an electric signal from the controller, and a mechanical governor control unit in which a motor is coupled to a governor lever of a mechanical fuel injection pump and a position of the governor lever is controlled by driving the motor in accordance with a command value from the controller so that the governor lever takes a predetermined position at. which the target engine revolution speed is achieved. The fuel injection device 14 in this embodiment may be any suitable type.

The prime mover 10 is provided with a target engine-revolution-speed input unit 71 through which the operator manually enters a target engine revolution speed. As shown in FIG. 4, an input signal of the target engine revolution speed NR0 is taken into the controller 70, and a signal of the target engine revolution speed command NR1 is output from the controller 70 to the fuel injection device 14 for controlling the revolution speed of the prime mover 10. The target engine-revolution-speed input unit 71 may comprise electric input means, such as a potentiometer, for directly entering the signal to the controller 70, thus enabling the operator to select the magnitude of the target engine revolution speed as a reference.

Also, the control system includes a revolution speed sensor 72 for detecting an actual revolution speed NE1 of the prime mover 10, and pressure sensors 73, 74 (see FIG. 3) for detecting the control pilot pressures PL1, PL2 for the hydraulic pumps 1, 2.

As sensors for detecting environment of the prime mover 10, there are further provided an atmospheric pressure sensor 75, a fuel temperature sensor 76, a cooling water temperature sensor 77, an intake temperature sensor 78, an intake pressure sensor 79, an exhaust temperature sensor 80, an exhaust pressure sensor 81, and an engine oil temperature sensor 82 which output respectively an atmospheric pressure sensor signal TA, a fuel temperature sensor signal TF, a cooling water temperature sensor signal TW, an intake temperature sensor signal TI, an intake pressure sensor signal PI, an exhaust temperature sensor signal TO, an exhaust pressure sensor signal PO, and an engine oil temperature sensor signal TL.

FIG. 4 shows input/output relations of all signals to and from the controller 70. The controller 70 receives the signal of the target engine revolution speed NR0 from the target engine-revolution-speed input unit 71, and outputs the signal of the target revolution speed NR1 to the fuel injection device 14 for controlling the revolution speed of the prime mover 10, as described above. In addition, the controller 70 receives a signal of the actual revolution speed NE1 from the revolution speed sensor 72, signals of the pump control pilot pressures PL1, PL2 from the pressure sensors 73, 74, and signals from the environment sensors 75–82, i.e., the atmospheric pressure sensor signal TA, the fuel temperature sensor signal TF, the cooling water temperature sensor signal TW, the intake temperature sensor signal TI, the intake pressure sensor signal PI, the exhaust temperature sensor signal TO, the exhaust pressure sensor signal PO, and the engine oil temperature sensor signal TL. After executing predetermined arithmetic operations, the controller 70 outputs the drive currents SI1, SI2, SI3 to the solenoid control valves 30–32, respectively, for controlling the tilting positions, i.e., the delivery rates, of the hydraulic pumps 1, 2.

Figure 5:
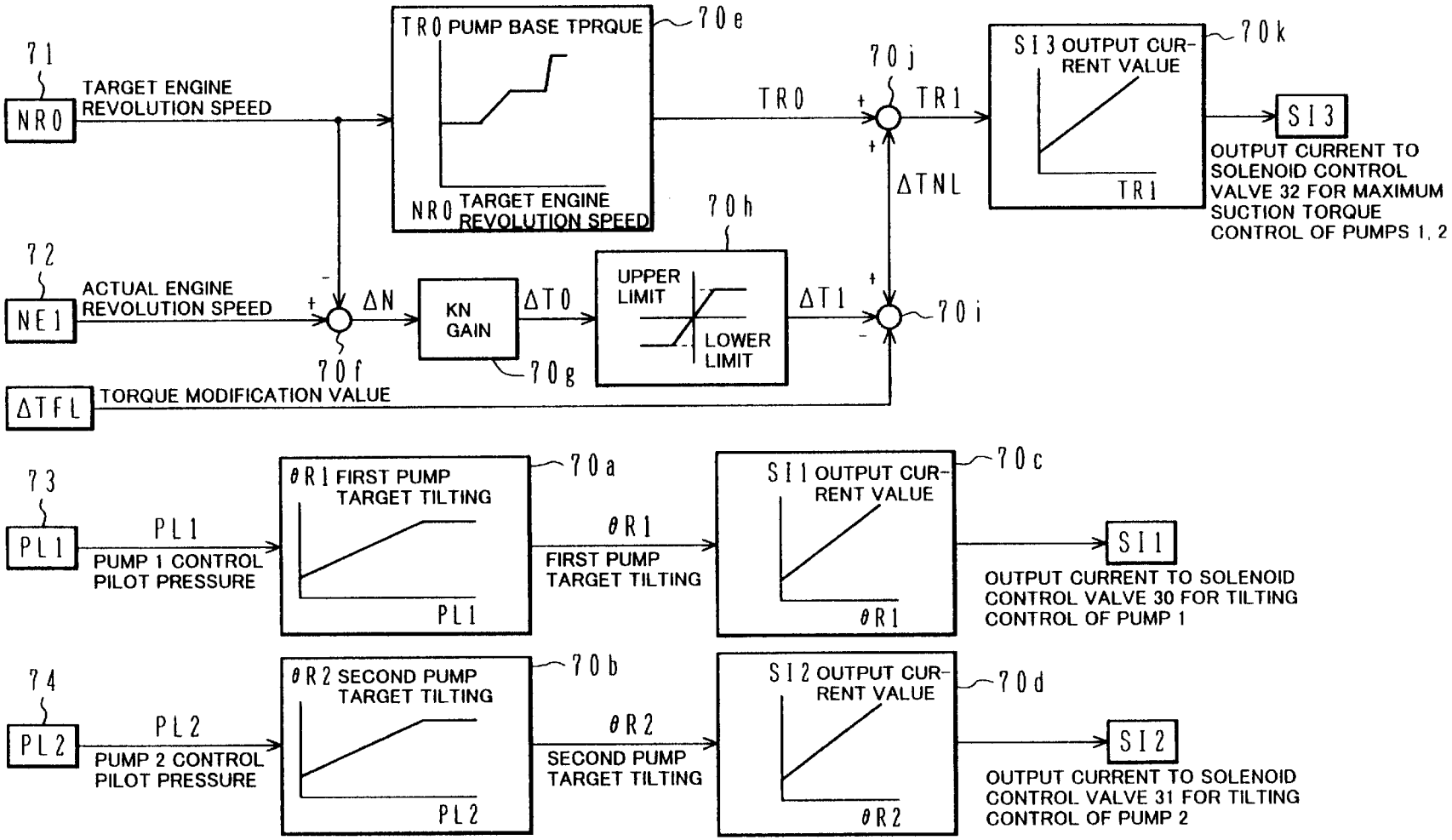
FIG. 5 is a functional block diagram showing part of processing functions of the controller.
Figure 6:
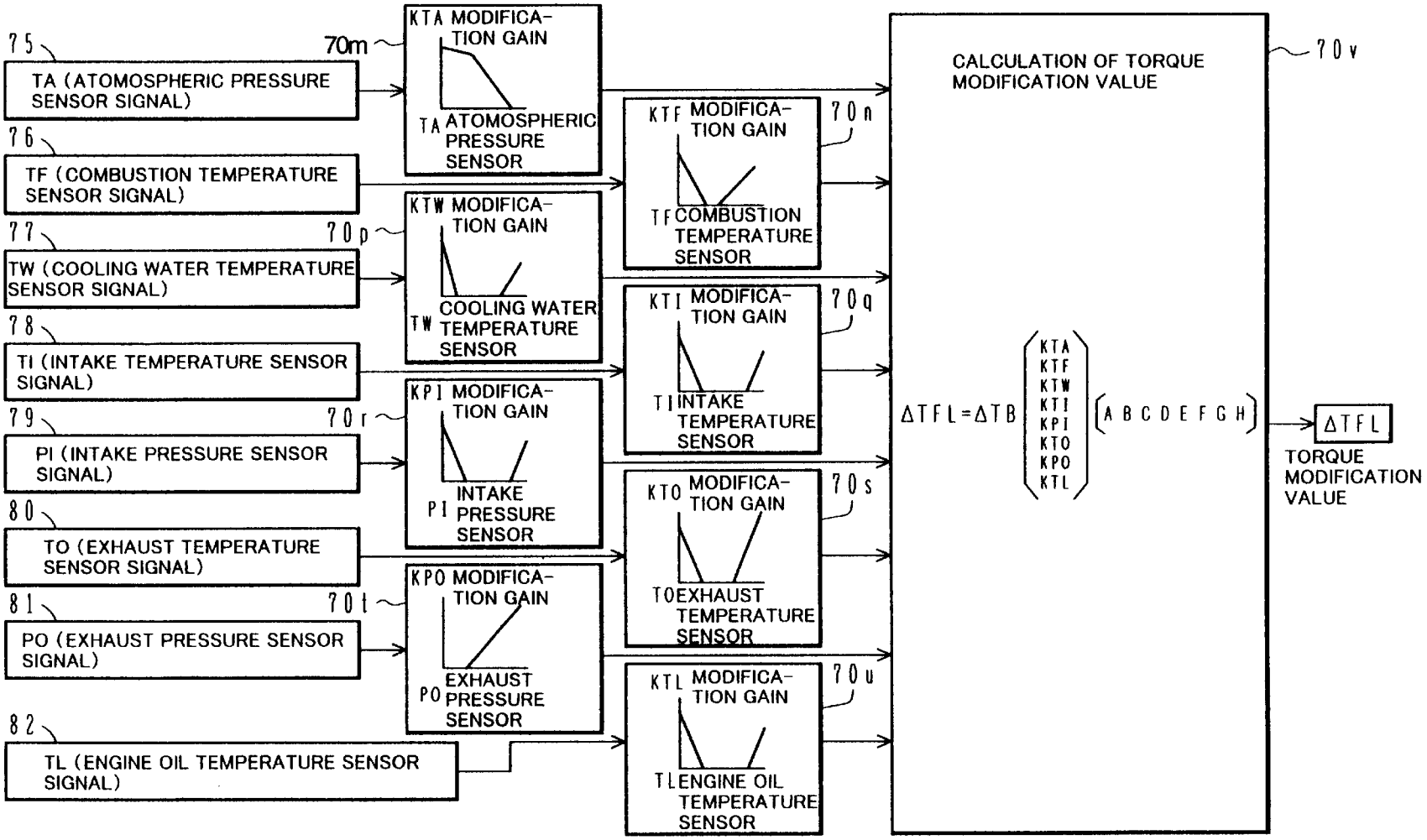
FIG. 6 is a functional block diagram showing another part of the processing functions of the controller.

FIGS. 5 and 6 show processing functions executed by the controller 70 for control of the hydraulic pumps 1, 2.

In FIG. 5, the controller 70 has functions of pump target tilting calculating portions 70*a*, 70*b*, solenoid output current calculating portions 70*c*, 70*d*, a base torque calculating portion 70*e*, a revolution speed deviation calculating portion 70*f*, a torque converting portion 70*g*, a limit calculating portion 70*h*, a speed sensing torque deviation modifying portion 70*i*, a base torque modifying portion 70*j*, and a solenoid output current calculating portion 70*k*.

In FIG. 6, the controller 70 further has functions of modification gain calculating portions 70*m*, 70*n*, 70*p–u* and a torque modification value calculating portion 70*v*.

In FIG. 5, the pump target tilting calculating portion 70*a* receives the signal of the control pilot pressure PL1 for the hydraulic pump 1 and calculates a first pump target tilting θR1 of the hydraulic pump 1 corresponding to the control pilot pressure PL1 at that time by referring to a relevant table stored in a memory. The target tilting θR1 is a reference flow metering value for positive tilting control in accordance with the input amounts from the pilot operating devices 38, 40, 41 and 42. In the memory table, a relationship between PL1 and θR1 is set such that the target tilting θR1 increases as the control pilot pressure PL1 rises.

The solenoid output current calculating portion 70*c* determines, based on θR1, the drive current SI1 for tilting control of the hydraulic pump 1 to provide θR1, and outputs the drive current SI1 to the solenoid control valve 30.

Likewise, with the pump target tilting calculating portion 70*b* and the solenoid output current calculating portion 70*d*, the drive current SI2 for tilting control of the hydraulic pump 2 is calculated based on the signal of the pump control pilot pressure PL2 and is then output to the solenoid control valve 31. In FIG. 5, the second pump target tilting is referenced by θR2.

The base torque calculating portion 70*e* receives the signal of the target engine revolution speed NR0 and calculates a pump base torque TR0 corresponding to the target engine revolution speed NR0 at that time by referring to a relevant table stored in a memory. In the memory table, a relationship between NR0 and TR0 is set such that the pump base torque TR0 increases as the target engine revolution speed NR0 rises.

The revolution speed deviation calculating portion 70*f* calculates a revolution speed deviation ΔN which represents a difference between the target engine revolution speed NR0 and the actual engine revolution speed NE1.

The torque converting portion 70*g* calculates a speed sensing torque deviation ΔT0 by multiplying the revolution speed deviation ΔN by a speed sensing gain KN.

The limit calculating portion 70*h* calculates a speed sensing torque deviation ΔT1 by multiplying the speed sensing torque deviation ΔT0 by upper and lower limits.

The speed sensing torque deviation modifying portion 70*i* calculates a torque deviation ΔTNL by subtracting, from the speed sensing torque deviation ΔT1, a torque modification value ΔTFL obtained by the processing in FIG. 6.

The base torque modifying portion 70*j* calculates a suction torque TR1 by adding the torque deviation ΔTNL to the pump base torque TR0 determined by the base torque calculating portion 70*e*. The resulting TR1 becomes a target maximum suction torque of the hydraulic pumps 1, 2.

The solenoid output current calculating portion 70*k* determines, based on TR1, the drive current SI3 for maximum suction torque control of the hydraulic pumps 1, 2 to provide TR1, and outputs the drive current SI3 to the solenoid control valve 32.

In FIG. 6, the modification gain calculating portion 70*m* receives the atmospheric pressure sensor signal TA and calculates a modification gain KTA corresponding to the atmospheric pressure sensor signal TA at that time by referring to a relevant table stored in a memory. The modification gain KTA is provided by determining a modification value from a relevant characteristic of the engine alone and storing it beforehand. The following other modification gains are also provided in a like manner.

Here, in view of the fact that the engine output power is reduced with a lowering of the atmospheric pressure, a relationship between the atmospheric pressure sensor signal TA and the modification gain KTA is set in the memory table such that the modification gain KTA increases as the atmospheric pressure sensor signal TA becomes smaller.

The modification gain calculating portion 70*n* receives the fuel temperature sensor signal TF and calculates a modification gain KTF corresponding to the fuel temperature sensor signal TF at that time by referring to a relevant table stored in a memory.

Here, in view of the fact that the engine output power is reduced when the fuel temperature is low or high, a relationship between the fuel temperature sensor signal TF and the modification gain KTF is set in the memory table such that the modification gain KTF increases as the fuel temperature sensor signal TF becomes smaller, and also increases as the fuel temperature sensor signal TF becomes larger.

The modification gain calculating portion 70*p* receives the cooling water temperature sensor signal TW and calculates a modification gain KTW corresponding to the cooling water temperature sensor signal TW at that time by referring to a relevant table stored in a memory.

Here, in view of the fact that the engine output power is reduced when the cooling water temperature is low or high, a relationship between the cooling water temperature sensor signal TW and the modification gain KTW is set in the memory table such that the modification gain KTW increases as the cooling water temperature sensor signal TW becomes smaller, and also increases as the cooling water temperature sensor signal TW becomes larger.

The modification gain calculating portion 70*q* receives the intake temperature sensor signal TI and calculates a modification gain KTI corresponding to the intake temperature sensor signal TI at that time by referring to a relevant table stored in a memory.

Here, in view of the fact that the engine output power is reduced when the intake temperature is low or high, a relationship between the intake temperature sensor signal TI and the modification gain KTI is set in the memory table such that the modification gain KTI increases as the intake temperature sensor signal TI becomes smaller, and also increases as the intake temperature sensor signal TI becomes larger.

The modification gain calculating portion 70*r* receives the intake pressure sensor signal PI and calculates a modification gain KPI corresponding to the intake pressure sensor signal PI at that time by referring to a relevant table stored in a memory.

Here, in view of the fact that the engine output power is reduced when the intake pressure is low or high, a relationship between the intake pressure sensor signal PI and the modification gain KPI is set in the memory table such that the modification gain KPI increases as the intake pressure sensor signal PI becomes smaller, and also increases as the intake pressure sensor signal PI becomes larger.

The modification gain calculating portion 70*s* receives the exhaust temperature sensor signal TO and calculates a modification gain KTO corresponding to the exhaust temperature sensor signal TO at that time by referring to a relevant table stored in a memory.

Here, in view of the fact that the engine output power is reduced when the exhaust temperature is low or high, a relationship between the exhaust temperature sensor signal TO and the modification gain KTO is set in the memory table such that the modification gain KTO increases as the exhaust temperature sensor signal TO becomes smaller, and also increases as the exhaust temperature sensor signal TO becomes larger.

The modification gain calculating portion 70*t* receives the exhaust pressure sensor signal PO and calculates a modification gain KPO corresponding to the exhaust pressure sensor signal PO at that time by referring to a relevant table stored in a memory.

Here, in view of the fact that the engine output power is reduced with a rising of the exhaust pressure, a relationship between the exhaust pressure sensor signal PO and the modification gain KPO is set in the memory table such that the modification gain KPO increases as the exhaust pressure sensor signal PO becomes larger.

The modification gain calculating portion 70*u* receives the engine oil temperature sensor signal TL and calculates a modification gain KTL corresponding to the engine oil temperature sensor signal TL at that time by referring to a relevant table stored in a memory.

Here, in view of the fact that the engine output power is reduced when the engine oil temperature is low or high, a relationship between the engine oil temperature sensor signal TL and the modification gain KTL is set in the memory table such that the modification gain KTL increases as the engine oil temperature sensor signal TL becomes smaller, and also increases as the engine oil temperature sensor signal TL becomes larger.

The torque modification value calculating portion 70*v* calculates the torque modification value ΔTFL after weighting the modification gains, which are calculated by the above modification gain calculating portion 70*m*, 70*n*, 70*p–u*, with respective weights. More specifically, amounts by which the engine output power lowers in accordance with the respective modification gains are determined beforehand for the performance specific to the engine, and a reference torque modification value ΔTB for the torque modification value ΔTFL to be eventually determined is stored as a constant in the controller. Also, weights to be imposed on the respective modification gains are determined beforehand, and weight modification values are stored as matrix elements A, B, C, D, E, F, G and H in the controller. The torque modification value ΔTFL is then computed based on a calculation formula, shown in a torque modification value calculating block of FIG. 6, by using the above-mentioned values.

The calculation formula in FIG. 6 is shown as being expressed by an equation of the first degree. It is to be however noted that in the case where the calculation formula is expressed by, e.g., an equation of the second degree, a similar advantage can also be obtained because the calculation intends to finally determine the torque modification value ΔTFL in any way.

The solenoid control valve 32 having received the drive current SI3 thus produced controls, as described above, the maximum suction torque of the hydraulic pumps 1, 2.

In the construction described above, the target engine-revolution-speed input unit 71 constitutes input means for instructing the target revolution speed of the prime mover (engine) 10, and the revolution speed sensor 72 constitutes first detecting means for detecting the actual revolution speed of the prime mover. The base torque calculating portion 70*e*, the revolution speed deviation calculating portion 70*f*, the torque converting portion 70*g*, the limit calculating portion 70*h*, the base torque modifying portion 70*j*, the solenoid output current calculating portion 70*k*, the solenoid control valve 32, and the second servo valves 22A, 22B constitute speed sensing control means for calculating a deviation between the target revolution speed and the actual revolution speed, and controlling the maximum suction torque of the hydraulic pumps 1, 2 in accordance with the calculated deviation.

Also, the environment sensors 75–82 constitute second detecting means for detecting status variables relating to the environment of the prime mover 10. The modification gain calculating portions 70*m*, 70*n*, 70*p–u*, the torque modification value calculating portion 70*v*, and the speed sensing torque deviation modifying portion 70*i* constitute torque modifying means for, in accordance with values detected by the second detecting means, modifying the maximum suction torque of the hydraulic pumps 1, 2 to be controlled by the speed sensing control means.

Further, the speed sensing control means, the second detecting means, and the torque modifying means constitute the torque control system for a hydraulic pump according to the present invention.

Features of the operation of this embodiment having the above construction will be described below.

Figure 7:
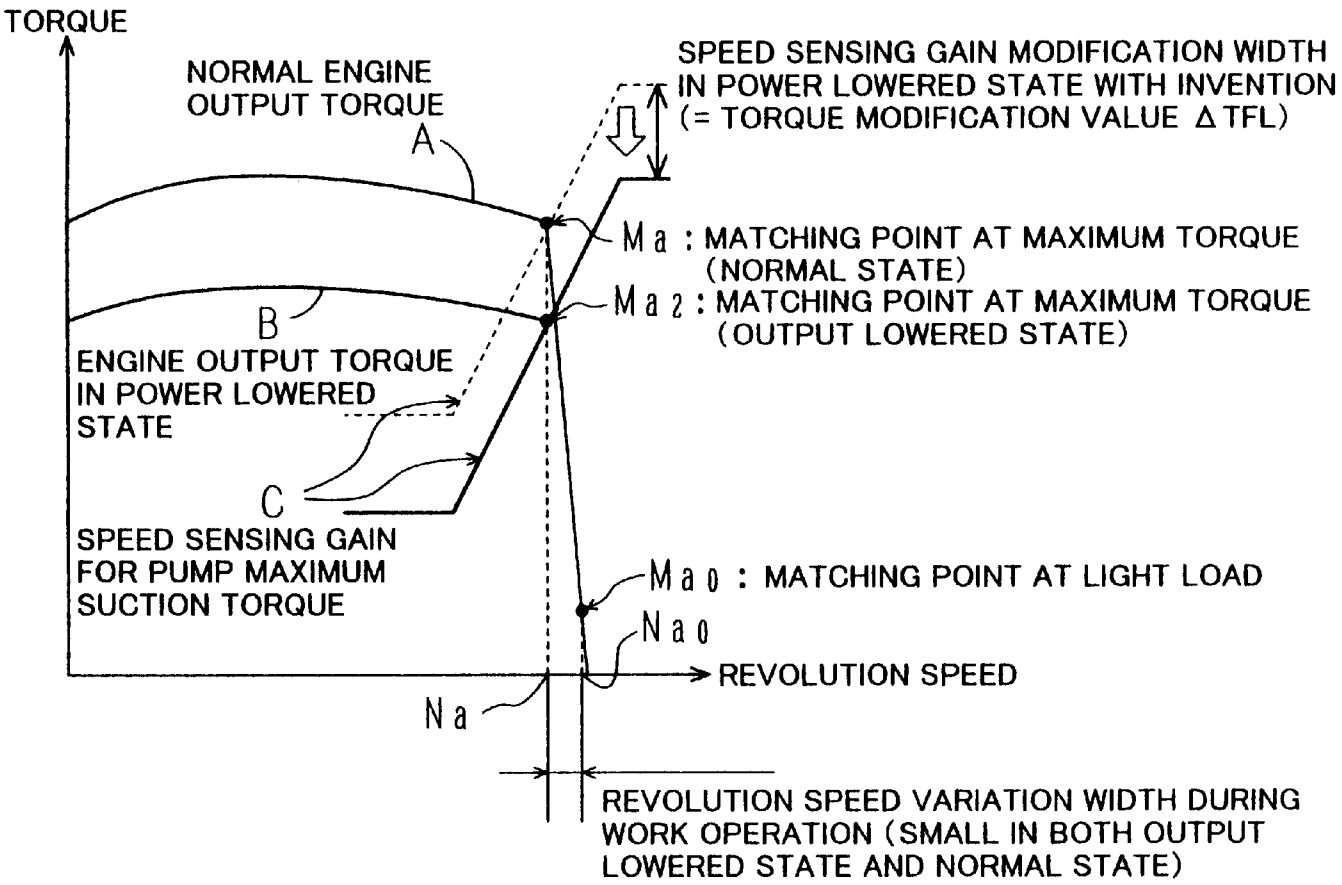
FIG. 7 is a graph showing matching points between an engine output torque and a pump suction torque under speed sensing control according to the first embodiment.
Figure 8:
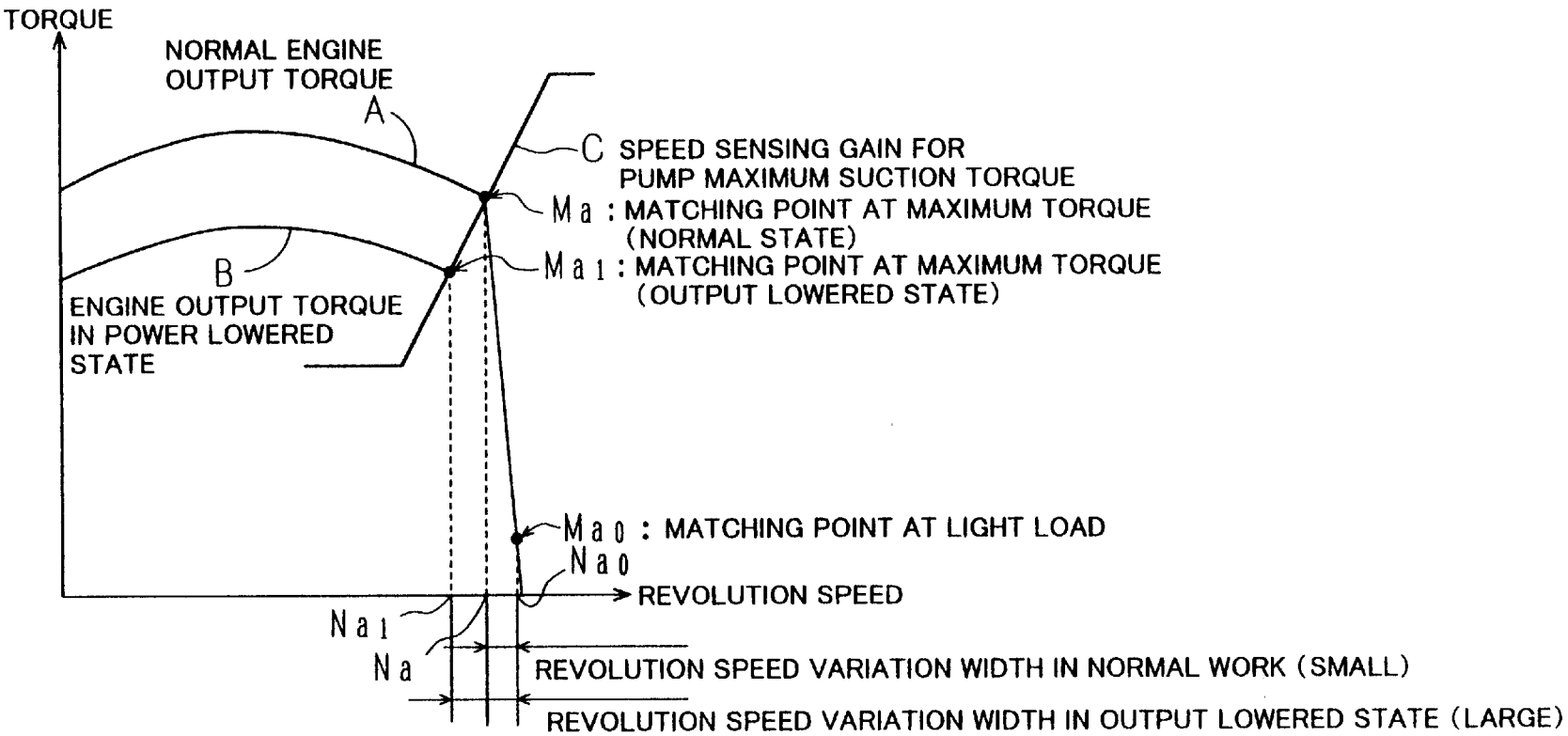
FIG. 8 is a graph showing matching points between an engine output torque and a pump suction torque under conventional speed sensing control.

FIG. 7 is a graph showing matching points between an engine output torque and a pump suction torque achieved with the torque control system of the present invention. For comparison, FIG. 8 is a graph showing matching points between an engine output torque and a pump suction torque under conventional speed sensing control. In both the cases, those matching points are obtained for the engine output torque in a normal state and in an output lowered state due to change of the environment on condition that the target revolution speed is fixed.

It is here supposed that, in the conventional speed sensing control, the speed sensing torque deviation modifying portion 70*i* shown in FIG. 5 is eliminated and the speed sensing torque deviation ΔT1 calculated by the limit calculating portion 70*h* is added directly to the pump base torque TR0 in the base torque modifying portion 70*j*, the resulting value being used as the target maximum suction torque.

A lowering of the engine output power varies depending on environment of the engine. For example, when the excavator is employed in high ground, the engine output torque lowers from a level indicated by a curve A to that indicated by a curve B because of a reduction of the atmospheric pressure.

When the engine load (i.e., the suction torque of the hydraulic pumps) is light, some point on a regulation curve of the fuel injection device (governor mechanism) becomes a matching point between the engine load and the output torque. Thus, assuming the target revolution speed to be Na, the engine revolution speed is given by a value, which is a little higher than the target revolution speed Na and corresponds to a point Na0 on the regulation characteristic curve of the governor mechanism, under the light load regardless of a lowering of the engine output power. The above description is equally applied to both this embodiment represented by FIG. 7 and the prior art represented by FIG. 8.

When the engine load increases, a matching point between the engine load and the output torque is given by a point on the engine output torque curve A or B. Such a point is called a maximum torque matching point.

In a normal output power state, the maximum torque matching point is provided by a point Ma which locates on the engine output torque curve A and corresponds to the target revolution speed Na. In both FIGS. 7 and 8, the designation Mao refers to matching point at light load. As the engine load changes from a light load to a high load during the operation of the hydraulic excavator, the engine revolution speed lowers from Na0 to Na. This is also equally applied to both this embodiment represented by FIG. 7 and the prior art represented by FIG. 8.

When the engine output power lowers due to change of the environment, the speed sensing control is carried out in the prior art to lower the suction torque of the hydraulic pumps corresponding to a reduction of the engine revolution speed (an increase of the revolution speed deviation ΔN). At this time, a proportion of the lowering of the pump maximum suction torque to the reduction of the engine revolution speed (the increase of the revolution speed deviation ΔN) is determined by the gain KN of the torque converting portion 70*g* shown in FIG. 5. That gain is called a speed sensing gain of the pump maximum suction torque that corresponds to a characteristic indicated by "C" in FIG. 8.

Under the conventional speed sensing control, because of the absence of the speed sensing torque deviation modifying portion 70*i* shown in FIG. 5, the characteristic of the speed sensing gain C is constant even with the engine output power lowered due to change of the environment. Accordingly, when the engine output lowers from the curve A to the curve B upon an increase of the engine load, the suction torque of the hydraulic pumps is lowered under the speed sensing control along the characteristic of the gain C corresponding to the reduction of the engine revolution speed until reaching a match at a point Ma1 where the suction torque of the hydraulic pumps and the engine output torque are equal to each other. In other words, the matching point moves from Ma to Ma1.

Thus, if the engine output power lowers due to change of the environment, the engine revolution speed is greatly reduced from Na0 to a point Na1 (<Na) as the engine load changes from a light load to a high load during the operation of the hydraulic excavator.

For example, where excavation is to be carried out in high ground, the engine revolution speed is given by Na0 a little higher than the target revolution speed Na entered by the operator when a bucket is empty, but the engine revolution speed is reduced to Na1 when excavation of earth and sand is started.

This changes noise and vibration of a machine body attributable to the engine revolution speed, thus making the operator more fatigued.

Comparing with the prior art described above, in this embodiment, if the engine output power lowers due to change of the environment, the sensors 75–82 detect the change of the environment. Then, the modification gain calculating portions 70*m*, 70*n*, 70*p–u* and the torque modification value calculating portion 70*v* receive the detected signals and estimate a lowering of the engine output power as the torque modification value ΔTFL. The speed sensing torque deviation modifying portion 70*i* and the base torque modifying portion 70*j* execute the process of determining the suction torque TR1 (target maximum suction torque) by adding the torque modification ΔTNL, which is obtained by subtracting the torque modification value ΔTFL from the speed sensing torque deviation ΔT1, to the pump base torque TR0. In other words, the above process implies that an amount by which the engine output power lowers due to change of the environment is calculated as the torque modification value ΔTFL, and the target maximum suction torque TR1 is reduced beforehand by reducing the pump base torque TR0 by such an amount. Thus, as the engine output power lowers (as the torque modification value ΔTFL increases), the characteristic of the speed sensing gain C for the pump maximum suction torque, shown in FIG. 7, is moved downward by an amount corresponding to the torque modification value ΔTFL.

As a result, in a state where the engine output power is lowered, the matching point between the engine output torque and the pump suction torque is given by a point Ma2. The engine revolution speed at the matching point is not changed from Na in the normal output power state, and hence satisfactory working efficiency can be ensured with a small reduction of the engine revolution speed.

With this embodiment, as described above, even when the engine output power lowers due to change of the environment, a reduction of the engine revolution speed can be suppressed and satisfactory working efficiency can be ensured at a high load.

Also, since the speed sensing to control the suction torque of the hydraulic pumps in accordance with the revolution deviation is carried out at all times as conventional, it is possible to prevent the engine from stalling even if the engine output power lowers upon an abrupt load being applied or an unexpected event being occurred.

Further, since the speed sensing control is carried out, the suction torque of the hydraulic pumps is not required to be set with an allowance beforehand, and the engine output power can be effectively utilized as conventional. Even when the engine output power lowers due to, for example, variations in equipment performance or change of the performance over time, it is possible to prevent the engine from stalling at a high load.

It is a matter of course that while, in the above-described embodiment, the torque modification value ΔTFL is subtracted from the speed sensing torque deviation ΔT1 in the speed sensing torque deviation modifying portion 70*i*, the torque modification value ΔTFL may be subtracted from the torque deviation ΔTNL in the base torque modifying portion 70*j*.

A second embodiment of the present invention will be described below with reference to FIGS. 9–11. In these drawings, equivalent components to those in FIGS. 5–7 are denoted by the same reference numerals.

Figure 9:
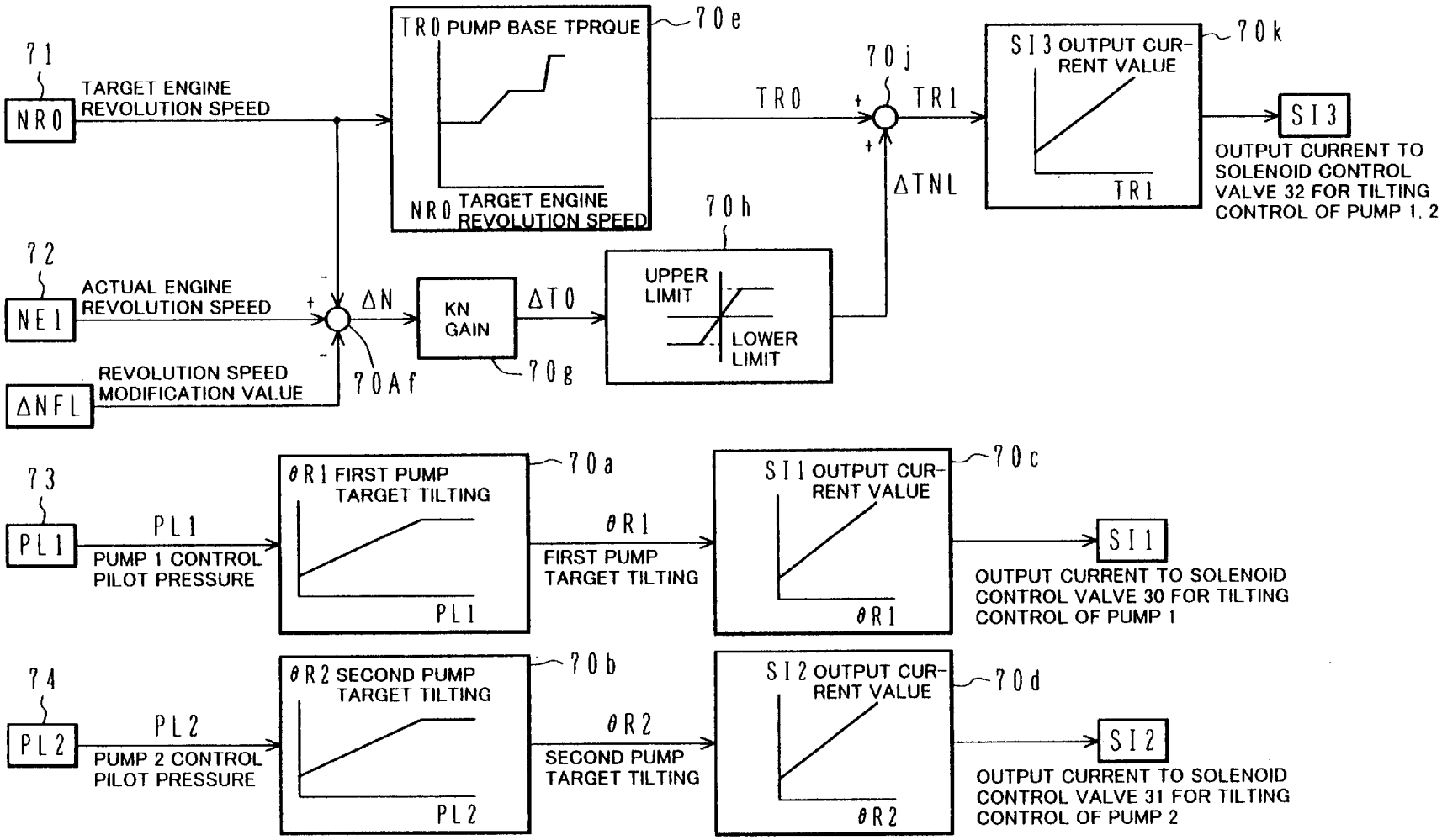
FIG. 9 is a functional block diagram showing part of processing functions of the controller according to a second embodiment of the present invention.

In FIG. 9, the controller has functions of pump target tilting calculating portions 70*a*, 70*b*, solenoid output current calculating portions 70*c*, 70*d*, a base torque calculating portion 70*e*, a revolution speed deviation calculating portion 70A*f*, a torque converting portion 70*g*, a limit calculating portion 70*h*, a base torque modifying portion 70*j*, and a solenoid output current calculating portion 70*k*. As in FIG. 5 relating to the first embodiment, the designation θR1 refers to first pump target tilting and the designation θR2 refers to second pump target tilting.

Figure 10:
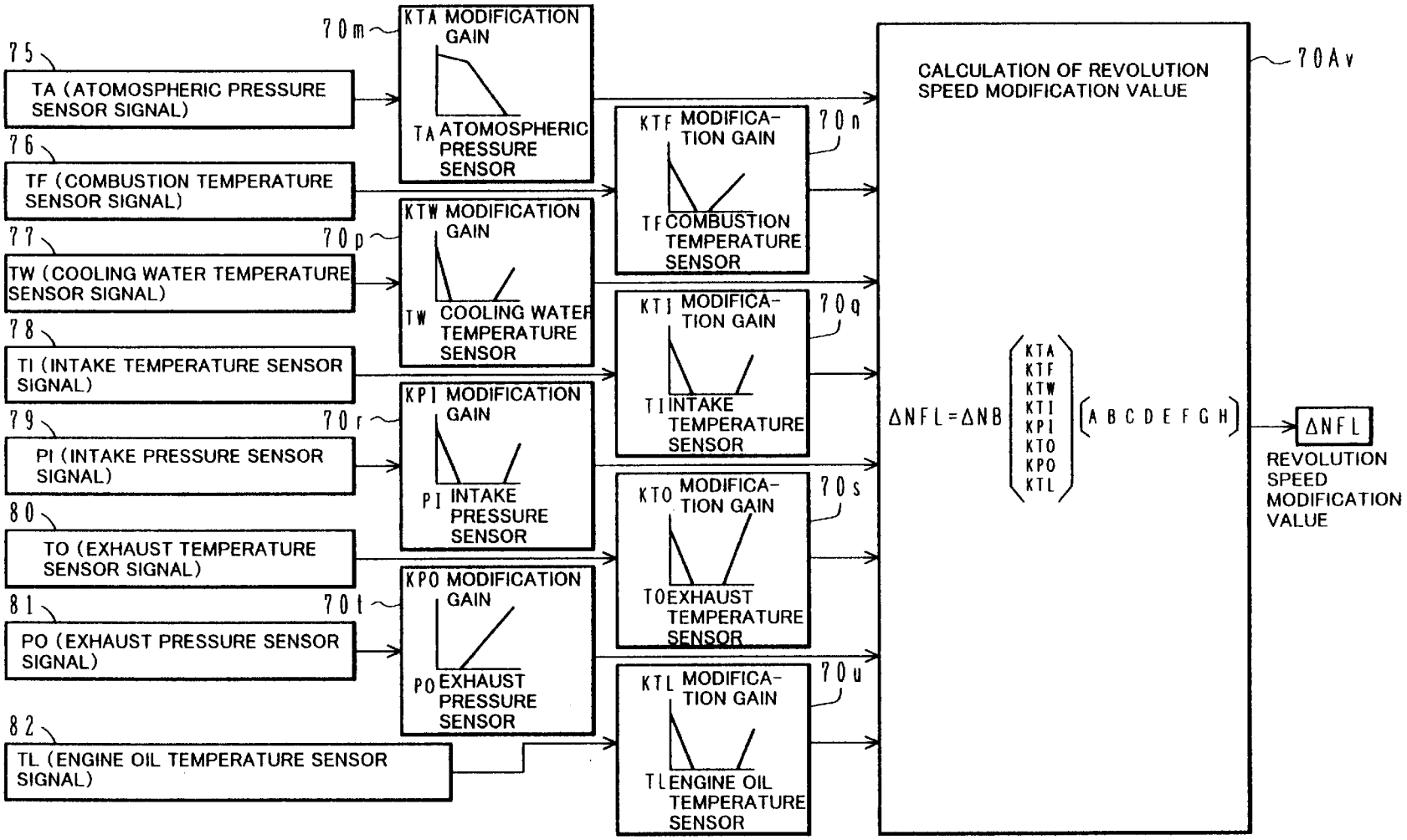
FIG. 10 is a functional block diagram showing another part of the processing functions of the controller.
Figure 11:
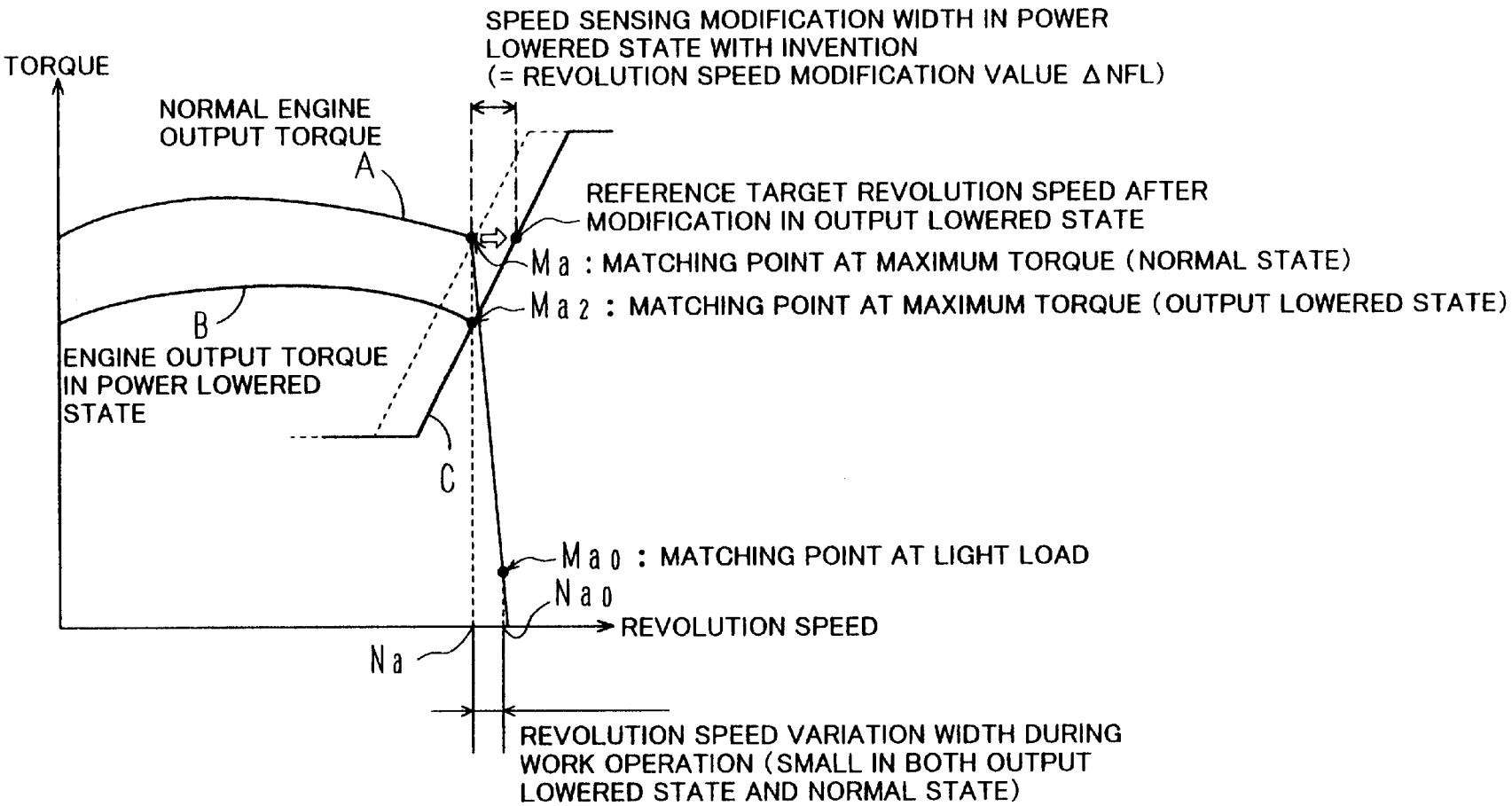
FIG. 11 is a graph showing matching points between an engine output torque and a pump suction torque under speed sensing control according to the second embodiment.

The revolution speed deviation calculating portion 70A*f* calculates a revolution speed deviation ΔN by determining a difference between the target engine revolution speed NR0 and the actual engine revolution speed NE1, and subtracting a revolution speed modification value ΔNFL, which is obtained by the processing in FIG. 10, from the difference.

The torque converting portion 70*g* calculates a speed sensing torque deviation ΔT0 by multiplying the revolution speed deviation ΔN by a speed sensing gain KN. Then, the limit calculating portion 70*h* calculates a speed sensing torque deviation ΔTNL by multiplying the speed sensing torque deviation ΔT0 by upper and lower limits. The base torque modifying portion 70*j* calculates a suction torque TR1 (target maximum suction torque) from the speed sensing torque deviation ΔTNL and the pump base torque TR0.

The other functions are the same as those in the first embodiment shown in FIG. 5.

In FIG. 10, the controller further has functions of modification gain calculating portions 70*m*, 70*n*, 70*p–u* and a revolution speed modification value calculating portion 70A*v*.

The processing executed in the modification gain calculating portions 70*m*, 70*n*, 70*p–u* is the same as that in the first embodiment shown in FIG. 6.

The revolution speed modification value calculating portion 70A*v* calculates the revolution speed modification value ΔNFL after weighting the modification gains, which are calculated by the above modification gain calculating portion 70*m*, 70*n*, 70*p–u*, with respective weights. More specifically, amounts by which the engine output power lowers in accordance with the respective modification gains are determined beforehand for the performance specific to the engine, and a reference revolution speed modification value ΔNB for the revolution speed modification value ΔNFL to be eventually determined is stored as a constant in the controller. Also, weights to be imposed on the respective modification gains are determined beforehand, and weight modification values are stored as matrix elements A, B, C, D, E, F, G and H in the controller. The revolution speed modification value ΔNFL is then computed based on a calculation formula, shown in a revolution speed modification value calculating block of FIG. 10, by using the above-mentioned values.

As with the above embodiment, a similar advantage can also be obtained in the case where the calculation formula in FIG. 6 is replaced by, e.g., an equation of the second degree.

The drive current SI3 produced by the solenoid output current calculating portion 70*k* is output to the solenoid control valve 32 shown in FIG. 1, thereby controlling the maximum suction torque of the hydraulic pumps 1, 2 as described above.

In the above-described construction of this embodiment, the modification gain calculating portions 70*m*, 70*n*, 70*p–u*, the revolution speed modification value calculating portion 70A*v*, and the revolution speed deviation calculating portion 70A*f* constitute torque modifying means for, in accordance with values detected by the second detecting means (the environment sensors 75–82), modifying the maximum suction torque of the hydraulic pumps 1, 2 to be controlled by the speed sensing control means (i.e., the base torque calculating portion 70*e*, the revolution speed deviation calculating portion 70*f*, the torque converting portion 70*g*, the limit calculating portion 70*h*, the base torque modifying portion 70*j*, the solenoid output current calculating portion 70*k*, the solenoid control valve 32, and the second servo valves 22A, 22B).

In this embodiment constructed as described above, if the engine output power lowers due to change of. the environment, the modification gain calculating portions 70*m*, 70*n*, 70*p–u* and the revolution speed modification value calculating portion 70A*v* receive the signals detected by the sensors 75–82 and estimate a lowering of the engine output power as the revolution speed modification value ΔNFL. The process of determining the suction torque TR1 (target maximum suction torque) is executed by subtracting the revolution speed modification value ΔNFL from the deviation between the target engine revolution speed NR0 and the actual engine revolution speed NE1 in the revolution speed deviation calculating portion 70A*f*, and then determining the speed sensing torque modification ΔTNL from the resulting revolution speed sensing deviation ΔN. In other words, the above process implies that an amount by which the engine output power lowers due to change of the environment is calculated as the revolution speed modification value ΔNFL, and the target maximum suction torque TR1 is reduced beforehand by reducing the target engine revolution speed NR0 by such an amount. Thus, as the engine output power lowers (as the revolution speed modification value ΔNFL increases), a characteristic of the speed sensing gain C for the pump maximum suction torque, shown in FIG. 11, is moved rightward on the drawing by an amount corresponding to the revolution speed modification value ΔNFL.

As a result, in a state where the engine output power is lowered, the matching point between the engine output power torque and the pump suction torque is given by a point Ma2 similarly to the first embodiment shown in FIG. 7. The engine revolution speed at the matching point is not changed from Na in the normal output power state. The designation Mao in FIG. 11 refers to matching point at light load.

With this embodiment, therefore, similar advantages to those obtainable with the first embodiment can be obtained. Specifically, satisfactory working efficiency can be ensured with a small reduction of the engine revolution speed. Further, since the speed sensing control is carried out, it is possible to prevent the engine from stalling even if the engine output power lowers upon a quick load being applied or an unexpected event being occurred.

The second embodiment has been described above as subtracting the revolution speed modification value ΔNFL from the deviation between the target engine revolution speed NR0 and the actual engine revolution speed NE1 in the revolution speed deviation calculating portion 70A*f*. This calculating process is equivalent to steps of adding the revolution speed modification value ΔNFL to the target engine revolution speed NR0, and then subtracting the resulting sum from the actual engine revolution speed NE1. Therefore, the above calculating process may be performed by providing means for adding the revolution speed modification value ΔNFL to the target engine revolution speed NR0, and subtracting an added value, which is obtained by the adding means, from the actual engine revolution speed NE1 in the revolution speed deviation calculating portion 70A*f*.

INDUSTRIAL APPLICABILITY

According to the present invention, even when the output power of a prime mover lowers due to change of the environment, a reduction of the revolution speed of the prime mover can be suppressed and satisfactory working efficiency can be ensured at a high load.

Also, since the speed sensing control is carried out as conventional, it is possible to prevent the prime mover from stalling even if the output power of the prime mover lowers upon an abrupt load being applied or an unexpected event being occurred.

Further, since the speed sensing control is carried out, the suction torque of a hydraulic pump is not required to be set with an allowance beforehand, and the output power of the prime mover can be effectively utilized as conventional. Even when the output power of the prime mover lowers due to, for example, variations in equipment performance or change of the performance over time, it is possible to prevent the prime mover from stalling at a high load.

What is claimed is:

1. A torque control system for a hydraulic pump in a hydraulic construction machine comprising a prime mover, a variable displacement hydraulic pump driven by said prime mover, input means for instructing a target revolution speed of said prime mover, first detecting means for detecting an actual revolution speed of said prime mover, and speed sensing control means between the target revolution speed and the actual revolution speed and controlling a maximum suction torque of said hydraulic pump such that the maximum suction torque decreases as the calculated deviation increases, wherein:

said torque control system includes second detecting means for detecting status variables relating to the environment of said prime mover, and torque modifying means for, in accordance with values detected by said second detecting means, modifying the maximum suction torque of said hydraulic pump to be controlled by said speed sensing control means (70*e*–70*h*, 70*j*, 70*k*, 32, 22A, 22B) such that the maximum suction torque corresponds to a change in the output power of said prime mover.

2. A torque control system for a hydraulic pump in a hydraulic construction machine according to claim 1, wherein said speed sensing control means comprises means for calculating a target maximum suction torque of said hydraulic pump based on said target revolution speed and said revolution speed deviation, and means for limitingly controlling a maximum displacement of said hydraulic pump in accordance with said target maximum suction torque, and wherein said torque modifying means modifies said target maximum suction torque in accordance with the values detected by said second detecting means.

3. A torque control system for a hydraulic pump in a hydraulic construction machine according to claim 1, wherein said torque modifying means comprises means for, for each of the status variables relating to the environment of said prime mover, determining an output power change of said prime mover corresponding to the detected value of the instantaneous status variable from a preset relationship between the status variable and said output power change, and means for modifying the maximum suction torque of said hydraulic pump in accordance with said output power change.

4. A torque control system for a hydraulic pump in a hydraulic construction machine according to claim 3, wherein said torque modifying means further comprises means for determining a modification value corresponding to the instantaneous output power change of said prime mover from a preset weighting function for said output power change depending on the status variables relating to the environment of said prime mover, and wherein said means for modifying the maximum suction torque of said hydraulic pump in accordance with said output power change modifies the maximum suction torque of said hydraulic pump in accordance with said modification value.

5. A torque control system for a hydraulic pump in a hydraulic construction machine according to claim 1, wherein said speed sensing control means comprises first means for calculating a pump base torque in accordance with said target revolution speed, calculating a speed sensing torque deviation in accordance with said revolution speed deviation, and adding the speed sensing torque deviation to the pump base torque to provide the target maximum suction torque of aid hydraulic pump, and second means for limitingly controlling a maximum displacement of said hydraulic pump in accordance with said target maximum suction torque, and wherein said torque modifying means comprises third means for calculating a torque modification value for said target maximum suction torque in accordance with the values detected by said second detecting means, and fourth means for subtracting the torque modification value when the speed sensing torque deviation is added to the pump base torque by said first means, thereby modifying said target maximum suction torque.

6. A torque control system for a hydraulic pump in a hydraulic construction machine according to claim 1, wherein said speed sensing control means comprises first means for calculating a pump base torque in accordance with said target revolution speed, subtracting said target revolution speed from said actual revolution speed to determine said revolution speed deviation, and modifying said pump base torque in accordance with said revolution speed deviation to provide the target maximum suction torque of said hydraulic pump, and second means for limitingly controlling a maximum displacement of said hydraulic pump in accordance with said target maximum suction torque, and wherein said torque modifying means comprises third means for calculating a revolution speed modification value for said target revolution speed in accordance with the values detected by said second detecting means, and fourth means for further subtracting the revolution speed modification value when said target revolution speed is subtracted from said actual revolution speed by said first means.

7. A torque control system for a hydraulic pump in a hydraulic construction machine according to claim 1, wherein said second detecting means comprises means for detecting the status variables relating to the environment of said prime mover including at least an external status variable of the hydraulic construction machine.

8. A torque control system for a hydraulic pump in a hydraulic construction machine comprising a prime mover, a variable displacement hydraulic pump driven by said prime mover, input means for instructing a target revolution speed of said prime mover, first detecting means for detecting an actual revolution speed of said prime mover, and speed sensing control means for calculating a deviation between the target revolution speed and the actual revolution speed and controlling a maximum suction torque of said hydraulic pump in accordance with the calculated deviation, wherein:

said torque control system includes second detecting means for detecting status variables relating to the environment of said prime mover which include at least an external status variable of the hydraulic construction machine, and torque modifying means for, in accordance with values detected by said second detecting means, modifying the maximum suction torque of said hydraulic pump to be controlled by said speed sensing control means.

* * * * *